US010689141B2

(12) United States Patent
Mühlschlegel et al.

(10) Patent No.: US 10,689,141 B2
(45) Date of Patent: Jun. 23, 2020

(54) THERMOFORM PACKAGING MACHINE WITH 2-AXIS ROBOT

(71) Applicant: MULTIVAC Sepp Haggenmüller SE & Co. KG, Wolfertschwenden (DE)

(72) Inventors: Johannes Mühlschlegel, Aitrach (DE); Martin Drechsler, Trunkelsberg (DE); Elmar Ehrmann, Bad Grönenbach (DE)

(73) Assignee: Multivac Sepp Haggenmüller SE & Co. KG, Wolfertschwenden (DE)

( * ) Notice: Subject to any disclaimer, the term of this patent is extended or adjusted under 35 U.S.C. 154(b) by 828 days.

(21) Appl. No.: 15/097,088

(22) Filed: Apr. 12, 2016

(65) Prior Publication Data

US 2016/0318641 A1 Nov. 3, 2016

(30) Foreign Application Priority Data

Apr. 29, 2015 (EP) ..... 15165569

(51) Int. Cl.

| | |
|---|---|
| ***B65B 35/18*** | (2006.01) |
| ***B65B 9/04*** | (2006.01) |
| ***B65B 61/28*** | (2006.01) |
| *B65B 7/16* | (2006.01) |

(52) U.S. Cl.

CPC ..... *B65B 35/18* (2013.01); *B65B 9/045* (2013.01); *B65B 61/28* (2013.01); *B65B 7/164* (2013.01); *B65B 2220/18* (2013.01)

(58) Field of Classification Search

CPC ..... B65B 35/18; B65B 9/045; B65B 7/164; B65B 31/021

USPC ..... 53/559

See application file for complete search history.

(56) References Cited

U.S. PATENT DOCUMENTS

| | | | | |
|---|---|---|---|---|
| 3,938,302 | A | 2/1976 | Donnet | |
| 6,769,231 | B2 * | 8/2004 | Danby | A21B 7/00 222/105 |
| 7,290,380 | B2 * | 11/2007 | Natterer | B65B 7/164 53/152 |
| 7,946,099 | B2 * | 5/2011 | Sparakowski | B65B 31/043 426/112 |

(Continued)

FOREIGN PATENT DOCUMENTS

| | | | |
|---|---|---|---|
| DE | 102006045191 | A1 | 5/2008 |
| DE | 102009016826 | A1 | 10/2009 |
| DE | 102010004630 | A1 | 7/2011 |

(Continued)

*Primary Examiner* — Chelsea E Stinson

(74) *Attorney, Agent, or Firm* — Husch Blackwell LLP

(57) ABSTRACT

A thermoform packaging machine comprising a forming station for thermoforming troughs in a bottom film web adapted to be conveyed in the thermoform packaging machine in a conveying direction, as well as a closing station for closing the troughs with a cover film. The machine further comprises a machine frame that includes a plurality of interconnected vertical members, longitudinal members, cross members, and machine feet. At least one substantially U-shaped or O-shaped portal is rigidly integrated in the machine frame, the portal comprising two columns and a crossbar extending between the two columns and above a conveying plane of the bottom film web transversely to the conveying direction, wherein the portal has a 2-axis robot mounted thereon.

12 Claims, 3 Drawing Sheets

(56) References Cited

U.S. PATENT DOCUMENTS

| | | | | |
|---|---|---|---|---|
| 2010/0135760 | A1* | 6/2010 | Hjornet | B25J 15/0616<br>414/744.8 |
| 2011/0167760 | A1* | 7/2011 | Spix | B65B 5/105<br>53/65 |

FOREIGN PATENT DOCUMENTS

| | | | |
|---|---|---|---|
| EP | 2778079 | A1 | 9/2014 |
| GB | 866314 | | 4/1961 |

* cited by examiner

THERMOFORM PACKAGING MACHINE WITH 2-AXIS ROBOT

CROSS-REFERENCE TO RELATED APPLICATIONS

This Application claims priority to European Patent Application Number 15165569.3 filed Apr. 29, 2015, to Johannes Mühlschlegel, Martin Drechsler and Elmar Ehrmann, currently pending, the entire disclosure of which is incorporated herein by reference.

FIELD OF THE INVENTION

The present invention relates to a thermoform packaging machine.

BACKGROUND OF THE INVENTION

Thermoform packaging machines are known, for example, from EP 2 778 079 A1. These conventional thermoform packaging machines make use of a robot or picker for placing products at an infeed line into packaging troughs thermoformed in a bottom film web. To this end, the robot is usually movably attached to a housing or portal of its own. This portal of the robot extends across the thermoform packaging machine and is not connected in any way to a machine frame of the thermoform packaging machine so as to prevent a transmission of vibrations from the robot portal to the thermoform packaging machine. Similar stand-alone portals or support frames for robots are known from DE 10 2009 0016 826 A1 or from DE 10 2010 004 630 A1.

SUMMARY OF THE INVENTION

One object of the present invention is to simplify the structural design of a thermoform packaging machine including a robot from the structural and functional point of view.

The thermoform packaging machine according to one embodiment of the present invention comprises a machine frame carrying the forming station and the closing station. This machine frame can include a plurality of interconnected vertical members, longitudinal members and cross members as well as machine feet for installing the thermoform packaging machine on the floor of a machine hall. The fact that the vertical members, the longitudinal members and the cross members are interconnected makes the machine frame highly torsion resistant.

According to one embodiment of the present invention, a substantially U-shaped or O-shaped portal is rigidly integrated in the machine frame. This portal may comprise two columns as well as a crossbar extending between the two columns and above a conveying plane of the bottom film web transversely to the conveying direction of the bottom film web. The portal can have a 2-axis robot provided thereon. The present invention thus turns away from conventional packaging machines, in the case of which robots always had large, self-supporting, stand-alone frame structures. The portal used for the robot according to one embodiment of the present invention can be U-shaped or O-shaped. With the exception of attachment parts, in one embodiment, the portal does not extend much further in the conveying direction of the thermoform packaging machine than the width of the columns and the crossbar. In other words, the portal may be essentially two-dimensional. Hence, the portal occupies very little space in the conveying direction of the thermoform packaging machine. This can allow for a very short, compact structural design of the whole thermoform packaging machine.

In addition, even a U-shaped portal that is open at the bottom and, even more, an O-shaped portal can contribute to an increase in the connection stiffness of the machine frame. This is unexpected considering the portal alone would not be able to stand freely. However, due to its integration in the machine frame and, in particular, due to the crossbar, which is provided above the film conveying plane and which establishes a connection between the two sides of the machine, the strength and the connection stiffness of the machine frame may increase substantially. Vibrations which may perhaps still originate from the 2-axis robot are thus no longer critical for the operation of the thermoform packaging machine.

"Integrated" means here that the portal may either be rigidly connected to the rest of the machine frame, for example, by welded joints, screw or rivet joints or the like, or it may also be a part of the machine frame itself, so that, for example, the columns of the portal fulfil the function of vertical members of the machine frame.

"Substantially U-shaped" means that, in the first approximation, the portal has a two-dimensional shape that is given by the two columns and the crossbar, although it goes without saying that these three components are, in turn, three-dimensional components and the crossbar may extend directly between the two columns or may abut on these two columns in laterally displaced fashion. The opening of the U shape of the portal is directed downwards. This opening may, however, also be closed, for example, by a cross member of the machine frame, so that, in total, an O-shaped portal is obtained.

The material used for the portal can be stainless steel, for example. This material provides high strength on one hand and is easy to clean on another hand.

The columns and/or the crossbar of the portal may have an H-shaped or U-shaped cross-section, wherein the robot, among other components, can be adapted to be attached to the outer sides of the cross-section. It can be, however, even more advantageous to provide closed sections, for example, a rectangular or square box section, since this kind of sections can be kept hygienic even more easily.

According to one embodiment, one of the machine feet is arranged directly below or directly beside a column of the portal. This can increase the stability and the connection stiffness of the thermoform packaging machine still further, since the forces introduced by the robot into the portal can immediately be dissipated via the machine foot into the floor. When the machine foot is arranged directly below the column, the machine foot may, for example, be screwed into the column from below. Arranging the machine foot "directly beside" a column can mean that a fastening block carrying the machine foot is laterally attached to the column. In the case of each of these embodiments it is imaginable that the machine foot is vertically adjustable, in that the machine foot may be screwed into the column or into the fastening block from below in a vertically adjustable manner.

Each of the columns of the portal may comprise a first section extending above the conveying plane of the bottom film web and connected to the crossbar, as well as a second section extending below the conveying plane. The second column section located below the conveying plane can make it easier to incorporate the column into the machine frame and may optionally also serve to carry a machine foot, as has been explained hereinbefore. The second, lower section of the columns may, again optionally, be formed integrally with longitudinal or cross members of the machine frame.

The functionality of the portal may be extended beyond its function of carrying the 2-axis robot. In one embodiment, the portal may have mounted thereon additional components or accessories of the thermoform packaging machine, for example, a film dispenser for dispensing the cover film, a film winder for winding up a residual film grid of the cover film and/or a labeler. Separate support structures for these additional components can thus be dispensed with, a circumstance that simplifies the structure and the design of the thermoform packaging machine. When the accessory components are attached to a side of the portal other than the side having the 2-axis robot mounted thereon, it will additionally be possible to reduce or even eliminate torques that may be applied by the robot to the portal.

According to one embodiment of the present invention, not only one portal, but a plurality of portals of the above described kind, may be provided, each of these portals having mounted thereon a 2-axis robot. One of these 2-axis robots may be used for placing articles or products into the packaging troughs and another robot may be used for separating the packages from one another or for removing the packages or for carrying a group of packages that has jointly been cut out of the common bottom film web by means of a full-cut tool.

The 2-axis robot may comprise a robot head movable with a first degree of freedom transversely to the conveying direction of the bottom film web and with a second degree of freedom in a vertical direction. Taking additionally into account that the bottom film web and the packaging troughs formed therein are conveyed in their conveying direction through the portal and, consequently, along the 2-axis robot, each point on the film web can be reached by the robot due to these two degrees of freedom.

The robot head itself may have mounted thereon a tool for carrying out defined working steps. The tool may be a gripping tool or a suction-type tool for placing articles or products into the packaging troughs, for separating packages from one another or for taking up finished, separated packages and for repositioning them, for example, into an outer package.

The tool may, in turn, be movable relative to the robot head, for example, translationally and/or rotationally, or the robot head itself may be rotationally movable. From this it can be seen that the term "2-axis robot" as used in the sense of the present invention only means that the robot head moves in a two-dimensional field of movement, but that this does not exclude additional degrees of freedom, such as a rotational movement of the robot head or a movement of the tool relative to the robot head.

Other and further objects of the invention, together with the features of novelty appurtenant thereto, will appear in the course of the following description.

DESCRIPTION OF THE SEVERAL VIEWS OF THE DRAWING

In the following, an advantageous embodiment of the present invention will be described in more detail making reference to a drawing, in which the individual figures show.

Like components are designated by like reference numerals throughout the figures.

DETAILED DESCRIPTION OF THE INVENTION

Figure 1:
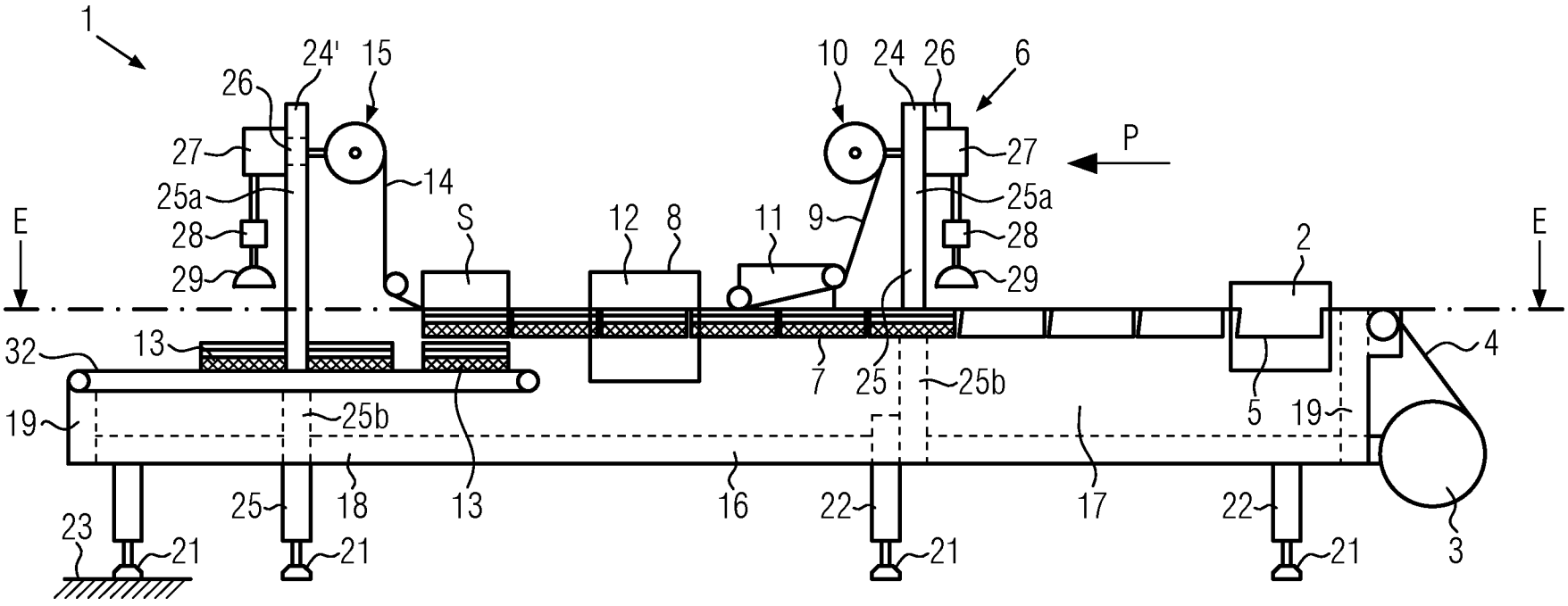
FIG. 1 is a schematic side view of a thermoform packaging machine according to one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows in a schematic side view a thermoform packaging machine 1 according to one embodiment of the present invention. The thermoform packaging machine 1 may comprise a forming station 2. In the forming station 2, packaging troughs 5 can be formed by means of thermoforming in a packaging film or bottom film web 4 unwound from a film roll 3. To this end, the bottom film web 4 may be configured as a thermoformable film, in particular as a plastic film. The bottom film web 4 can be conveyed through the packaging machine 1 in a conveying direction P in an intermittent feed mode. Non-formed areas of the bottom film web 4 or horizontal flange portions surrounding the troughs 5 may be positioned in a horizontal conveying plane E during conveyance.

At a filling or infeed station 6, a product 7 can be placed into the packaging troughs 5. This product 7 may be a foodstuff or other consumer goods.

A closing station 8 of the thermoform packaging machine 1 can serve to close the packaging troughs 5 with a cover film 9. The closing station 8 may be configured as a sealing station so as to sealingly attach the cover film 9 to the bottom film web 4 for closing the troughs 5. The cover film 9, which, just as the bottom film web 4, may consist of a sealable plastic film, can be unwound from a film dispenser 10. Via a roller guide 11, the cover film 9 may be transferred into the closing station 8.

In the closing station 8, a hermetically closed sealing chamber 12 can be formed around the packaging trough 5. This sealing chamber 12 is optionally evacuated and possibly gas flushed with a substitute gas before a sealing tool seals the cover film 9 onto the trough 5, preferably onto circumferentially extending rims of the trough 5. The part of the cover film 9 projecting beyond the packaging trough 5 may be separated from the now closed package 13 before the trough 5 leaves the closing station 8.

Downstream of the closing or sealing station 8, a cutting station S may be arranged. In the embodiment shown, the cutting station S is configured as a full-cut station, in which the packages 13 are separated from the bottom film web 4 with a single circumferential cut. Alternatively, the cutting station S may also comprise two successive separate stations, in which a transverse cut is carried out in one station and a longitudinal cut in the other, this being another way of separating the packages 13 from one another. A residual film grid 14 of the cover film 9, i.e., the areas of the cover film 9 which have not been sealed onto the packages 13, can be, starting from the cutting station S, supplied to a residual film winder 15 where it is collected. In the case of an alternative cutting station S, which is divided into a cross cutting station and a longitudinal cutting station, only a left and a right edge trim, instead of the residual film grid 14, would be supplied to the residual film winder 15.

Below the cutting station S, a discharge belt 32 can begin. The packages 13 separated from one another in the cutting station S may drop, due to gravity, onto the discharge belt 32 after having been cut out of the bottom film web 4. Subsequently, they are advanced in the conveying direction P by the discharge belt 32, the packages 13 being now located below the conveying plane E.

The thermoform packaging machine 1 additionally comprises a machine frame 16, most of which may be hidden inside or behind a side panel 17 and can therefore hardly be seen from outside. The machine frame 16 can comprise schematically shown longitudinal members 18, a plurality of vertical members 19 as well as cross members 20 (see FIGS. 2 and 3). The longitudinal members 18 extend generally in the conveying direction P, whereas the cross members 20 are normally generally horizontally oriented and extend transversely to the conveying direction P. The longitudinal members 18, vertical members 19 and cross members 20 are rigidly interconnected in a suitable manner, for example, by screw, rivet or welded joints, so as to form, in total, a rigid, three-dimensional machine frame 16. This machine frame 16 can carry the forming station 2 and the closing station 8, among other components. To this end, the forming station 2 and the closing station 8 may be fixed to or suspended from the machine frame 16 in a suitable manner.

The machine frame 16 may also comprise machine feet 21, at least some of which are screwed into fastening blocks 22 in a vertically adjustable manner. The machine feet 21 serve to install the thermoform packaging machine 1 on a floor or substrate 23.

The thermoform packaging machine 1 additionally may comprise at least one and in the shown embodiment, even two portals 24, 24'. Each of the two portals 24, 24' may comprise two substantially vertically oriented columns 25 installed on opposed sides of the bottom film web 4, so that, when the thermoform packaging machine 1 is in operation, the bottom film web 4 can be passed between the two columns of a portal 24, 24'. In addition, each portal 24 can include a crossbar 26 extending above the conveying plane E of the bottom film web 4 from one column to the other column 25, i.e., it interconnects the two columns 25 of the portals 24, 24' (see FIGS. 2 and 3). The crossbar 26 may be connected laterally to the columns 25, i.e., to the front or to the back of the columns 25 when seen in the conveying direction P, as shown in FIG. 1 on portal 24, or the crossbar 26 may extend in the same plane as the two columns 25 between the two columns 25. Due to the two columns 25 and the crossbar 26, each portal 24, 24' substantially has the shape of a U that is open at the bottom. Optionally, the portal 24, 24' may, however, also comprise at least one additional connection between the two columns 25, the connection being located below the conveying plane E. Such a portal 24, 24' would be substantially O-shaped.

The side view of FIG. 1 shows clearly that each portal 24, 24' has only very short dimensions in the conveying direction P of the thermoform packaging machine 1. This contributes substantially to a short structural design of the thermoform packaging machine 1.

Each portal 24, 24' has provided thereon a 2-axis robot 27. The robot 27 can comprise a robot head 28 movable in two degrees of freedom. The robot head 28 serves the purpose of fixing a tool 29. In the case of the portal constituting the first portal 24 in the conveying direction P, the tool 29 can be a gripping tool or a suction-type tool, by means of which the products 7 can be grasped and placed into the troughs 5. In the case of the robot 27 of the second portal 24', the robot head 28 carries a gripping tool, for example, a vacuum gripper 29, by means of which the finished, separated packages 13 can be removed from the discharge belt 32 and placed into cardboard boxes or other outer packages.

According to one embodiment of the present invention, each of the two portals 24, 24' has attached thereto additional components of the thermoform packaging machine 1. Portal 24, for example, carries the film dispenser 10 for the cover film 9, whereas the second portal 24' may have attached thereto the film winder 15 for the residual film grid 14 as well as, optionally, a labeler for labeling the closed packages 13. These additional components 10, 15 may be provided on the side of the respective portal 24, 24' that is located opposite the 2-axis robot 27, so as to optimize the load distribution on the portal 24, 24' and render it more uniform.

At the first portal 24, a fastening block 22 for a machine foot 21 can be attached directly to the side of the column 25 of the portal 24, whereas in the case of the second portal 24' a machine foot 21 can be screwed, directly from below, into the column 25. This means that, in both cases, the respective machine foot 21 is located at least in close proximity to the portal 24, 24', so that forces occurring there can be dissipated directly into the substrate 23.

According to one embodiment of the present invention, each of the columns 25 of the two portals 24, 24' comprises two sections, such as a first section **25*a* extending above the conveying plane E and having also secured thereto the crossbar 26, and a second section 25*b* extending below the conveying plane E. At the second section 25*b* the column 25 may be integrated in the machine frame 16. Except for the first sections 25*a* of the columns 25 located above the conveying plane E, the machine frame 16** may be positioned completely or at least almost completely below the film conveying plane E.

Figure 2:
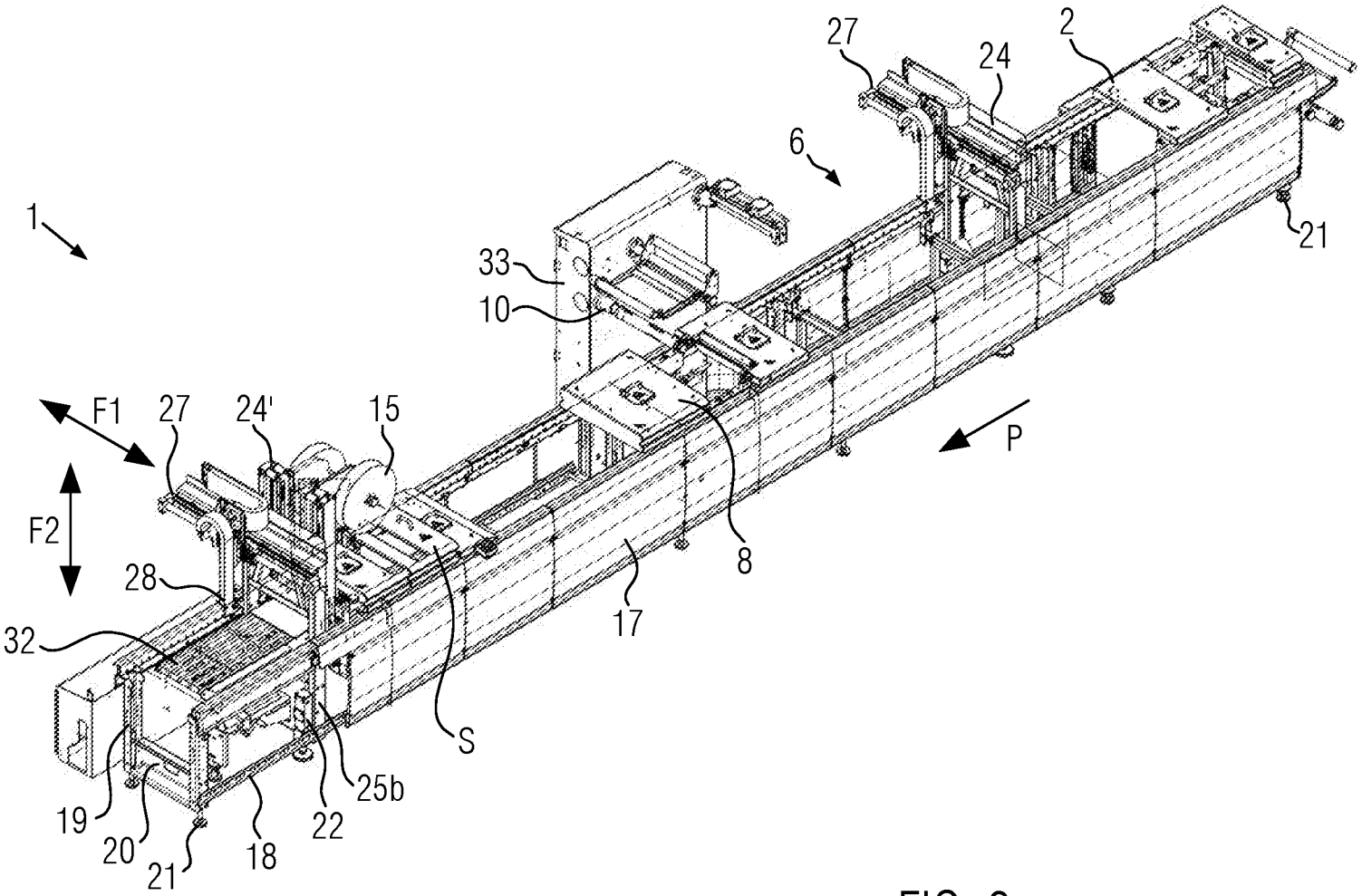
FIG. 2 is a perspective view of a thermoform packaging machine according to one embodiment of the present invention.

FIG. 2 shows, in a perspective view, a slightly modified embodiment of the thermoform packaging machine 1. One illustrated modification is that the film dispenser 10 for the cover film 9 is now no longer fastened to the first portal 24 but to a machine cabinet 33, which is installed at the side of the thermoform packaging machine 1 and which may also accommodate parts of the electrical system of the packaging machine 1. FIG. 2 additionally shows the two degrees of freedom F1, F2 of the movement of the robot head 28 of the 2-axis robot 27, wherein the first degree of freedom F1 is generally transverse to the conveying direction P and the second degree of freedom F2 is generally in a vertical direction. The 2-axis robot 27 on the first portal 24 can have the same two degrees of freedom F1, F2.

Figure 3:
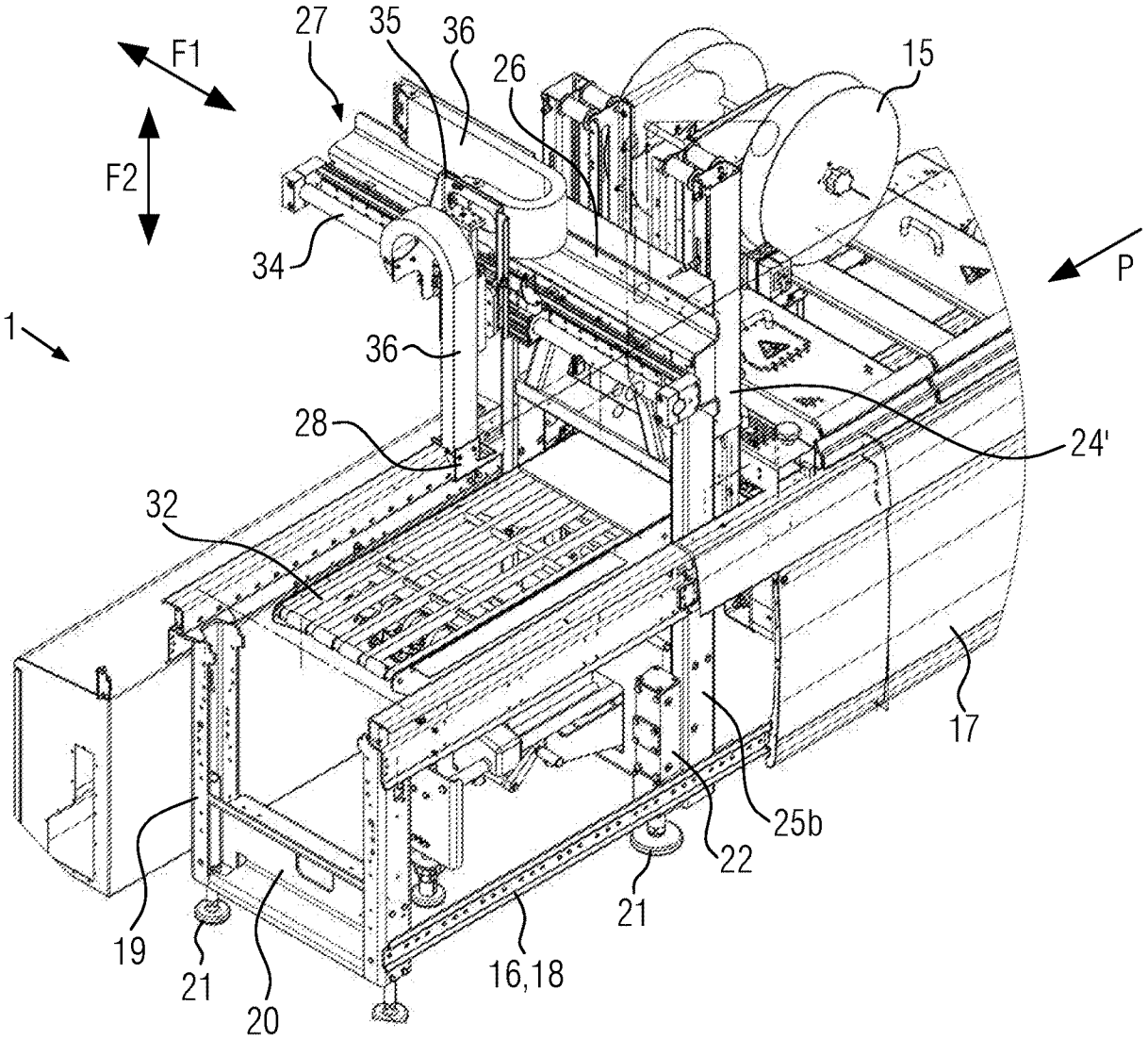
FIG. 3 is an enlarged perspective view of the thermoform packaging machine of FIG. 2.

FIG. 3 shows further details of the portal 24' and of the 2-axis robot 27. The three-dimensional structure of the machine frame 16 can also be seen here. The second, lower section **25*b* of column 25 of the portal 24' is shown as being connected to a fastening block 22 directly attached thereto and used for carrying a machine foot 21**.

Parallel to the crossbar 26, a rail 34 can be attached to the crossbar 26 such that a carriage 35 of the 2-axis robot 27 may be horizontally movable on the rail 34 in a direction transverse to the conveying direction P of the packaging machine, so as to realize the first degree of freedom F1 of the robot 27 in this way. The robot head 28 is generally always positioned vertically below the carriage 35 and can be adapted to be vertically displaced relative to the slide 35 so as to realize the second degree of freedom F2. Flexible cable ducts 36 ensure that electric lines and compressed-air or vacuum lines are caused to reliably follow the movement of the robot head 28. FIG. 3 also shows how the residual film winder 15 is attached to the portal 24'.

Taking as a basis the embodiments shown, the thermoform packaging machine according to the present invention can be modified in many respects. This refers especially to the number of portals 24, 24' with robots 27 provided on the thermoform packaging machine 1. As has already been explained, the 2-axis robots 27 are able to execute various functions that are different from one another. It goes without saying that a portal 24, 24' may also comprise a plurality of crossbars 26.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A thermoform packaging machine comprising:

a forming station for thermoforming troughs in a bottom film web adapted to be conveyed in the thermoform packaging machine in a conveying direction in a conveying plane;

a closing station for closing the troughs with a cover film;

a machine frame carrying the forming station and the closing station and including a plurality of interconnected vertical members, longitudinal members and cross members;

at least one substantially U-shaped or O-shaped portal disposed on the machine frame in a fixed position relative to the machine frame, wherein the at least one portal includes two columns and a crossbar extending from one of the two columns to the other column and above the conveying plane transversely to the conveying direction; and a 2-axis robot provided on the at least one portal.

2. The thermoform packaging machine according to claim 1 further comprising machine feet, wherein one of the machine feet is arranged directly on, directly below or directly beside at least one of the columns of the at least one portal.

3. The thermoform packaging machine according to claim 1, wherein each of the columns comprises a first section extending above the conveying plane and a second section extending below the conveying plane.

4. The thermoform packaging machine according to claim 1, wherein the columns and crossbar contain stainless steel.

5. The thermoform packaging machine according to claim 1, wherein the columns and crossbar have one of an H-shaped, a U-shaped and a closed cross-section.

6. The thermoform packaging machine according to claim 1, wherein the at least one portal has attached thereto at least one of a film dispenser for dispensing the cover film, a film winder for winding up a residual film grid and a labeler.

7. The thermoform packaging machine according to claim 1, wherein a plurality of portals are provided, each portal being disposed on the machine frame in a fixed position relative to the machine frame and having a 2-axis robot provided thereon.

8. The thermoform packaging machine according to claim 1, wherein the 2-axis robot comprises a robot head movable relative to the at least one portal in a first degree of freedom transversely to the conveying direction and a second degree of freedom in a vertical direction.

9. The thermoform packaging machine according to claim 8 further comprising a tool mounted on the robot head.

10. The thermoform packaging machine according to claim 9, wherein the tool is at least one of a gripping tool and a suction-type tool.

11. The thermoform packaging machine according to claim 8, wherein the tool is supported on the robot head such that it is rotatable relative thereto.

12. A thermoform packaging machine comprising:

a forming station for thermoforming troughs in a bottom film web adapted to be conveyed in the thermoform packaging machine in a conveying direction in a conveying plane;

a closing station for closing the troughs with a cover film;

a machine frame carrying the forming station and the closing station and including a plurality of interconnected vertical members, longitudinal members and cross members;

at least one substantially U-shaped or O-shaped portal being coupled to the machine frame at a fixed position thereon, wherein the at least one portal includes two columns, and a crossbar extending from one of the two columns to the other column and above the conveying plane transversely to the conveying direction; and a 2-axis robot provided on the at least one portal, wherein the 2-axis robot comprises a robot head movable relative to the fixed at least one portal in a first degree of freedom that is a vertical direction relative to a substantially horizontal conveying direction, and a second degree of freedom that is transverse to both the first degree of freedom and the substantially horizontal conveying direction.

* * * * *